US007272871B1

(12) United States Patent
Mudd

(10) Patent No.: US 7,272,871 B1
(45) Date of Patent: Sep. 25, 2007

(54) DIRT VESSEL EQUIPPED WITH CLEANING PLUNGER

(75) Inventor: Amy N. Mudd, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 649 days.

(21) Appl. No.: 10/687,317

(22) Filed: Oct. 16, 2003

Related U.S. Application Data

(60) Provisional application No. 60/419,661, filed on Oct. 18, 2002.

(51) Int. Cl.
*A47L 9/10* (2006.01)

(52) U.S. Cl. ..... 15/352; 55/430; 55/432; 55/433; 55/DIG. 3

(58) Field of Classification Search ..... 15/352; 55/430, 432, 433, DIG. 3
See application file for complete search history.

(56) References Cited

U.S. PATENT DOCUMENTS 6,003,196 A * 12/1999 Wright et al. ..... 15/353
6,706,095 B2 * 3/2004 Morgan ..... 95/268
2001/0025395 A1 * 10/2001 Matsumoto et al. ..... 15/353
2001/0042283 A1 * 11/2001 Oh et al. ..... 15/353
2002/0129462 A1 9/2002 Matusz et al.

FOREIGN PATENT DOCUMENTS

FR 2823091 * 10/2002
JP 54019558 A * 2/1979
JP 54028456 A * 3/1979
JP 54096264 A * 7/1979
JP 54103262 A * 8/1979

* cited by examiner

*Primary Examiner*—David Redding
(74) *Attorney, Agent, or Firm*—King & Schickli, PLLC

(57) ABSTRACT

A vacuum cleaner is provided including a housing, a nozzle inlet, a suction generator carried on the housing and a dirt vessel carried on the housing. The dirt vessel includes a sidewall and an open end. A plunger is received in the dirt vessel. The plunger is selectively displaceable between a first position spaced along the sidewall away from the open end and a second position spaced along the sidewall adjacent the open end.

15 Claims, 3 Drawing Sheets

DIRT VESSEL EQUIPPED WITH CLEANING PLUNGER

This application claims the benefit of U.S. Provisional Patent Application Ser. No. 60/419,661 filed Oct. 18, 2002.

TECHNICAL FIELD

The present invention relates generally to the floor care equipment field and, more particularly, to a vacuum cleaner incorporating a dirt collection assembly having a plunger for cleaning dirt and debris from a dirt collection vessel.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dirt collection assembly for an upright or canister vacuum cleaner.

SUMMARY OF THE INVENTION

In accordance with the purposes of the present invention as described herein, an improved vacuum cleaner is provided. That vacuum cleaner includes a housing, a nozzle inlet, a suction generator carried, and a dirt vessel. The dirt vessel includes a sidewall and an open end. A plunger is received in the dirt vessel. The plunger is selectively displaceable between a first position spaced along the sidewall away from the open end and a second position spaced along the sidewall adjacent the open end.

More specifically describing the invention, the plunger includes a margin slidingly engaging an inner surface of the sidewall. That margin includes a cleaning element in engagement with the sidewall. The cleaning element may comprise a resilient wiper, a brush, a pad or any other structure or component appropriate for sliding along and cleaning the interior surface of the sidewall.

Still further describing the invention, the dirt vessel may include a door for closing the open end thereof. The door may be connected by a hinge to the sidewall. A latch is provided for securing the door in a closed position relative to the sidewall.

The dirt vessel also includes an inlet and an outlet. The inlet may be provided in the plunger, the sidewall or the door. The outlet may also be provided in the plunger, the sidewall or the door.

Where cyclonic cleaning action is desired, the sidewall and door of the dirt vessel define a cylindrical dirt collection chamber. The inlet is provided in the sidewall and is tangentially directed with respect to the sidewall and the chamber. The outlet is provided in the door or the plunger. If desired a screen and/or cylindrical filter element may be provided over the outlet.

In accordance with yet another aspect of the present invention, a dirt vessel is provided. The dirt vessel includes a sidewall and an open end. As described above a plunger is received in the sidewall. The plunger is selectively displaceable between a first position spaced along the sidewall away from the open end and a second position spaced along the sidewall adjacent the open end.

Still further, the present invention also includes a method of cleaning dirt and debris from a dirt vessel of a vacuum cleaner. The method comprises equipping the dirt vessel with a plunger at one end of a dirt collection chamber in the dirt vessel and instructing a user to displace the plunger through the dirt collection chamber in order to remove dirt and debris from the dirt collection chamber.

In the following description there is shown and described several possible embodiments of the invention simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain certain principles of the invention. In the drawing.

Reference is now made in detail to the present preferred embodiment of the invention, an example of which is illustrated in the accompanying drawing.

DETAILED DESCRIPTION OF THE INVENTION

Figure 1:
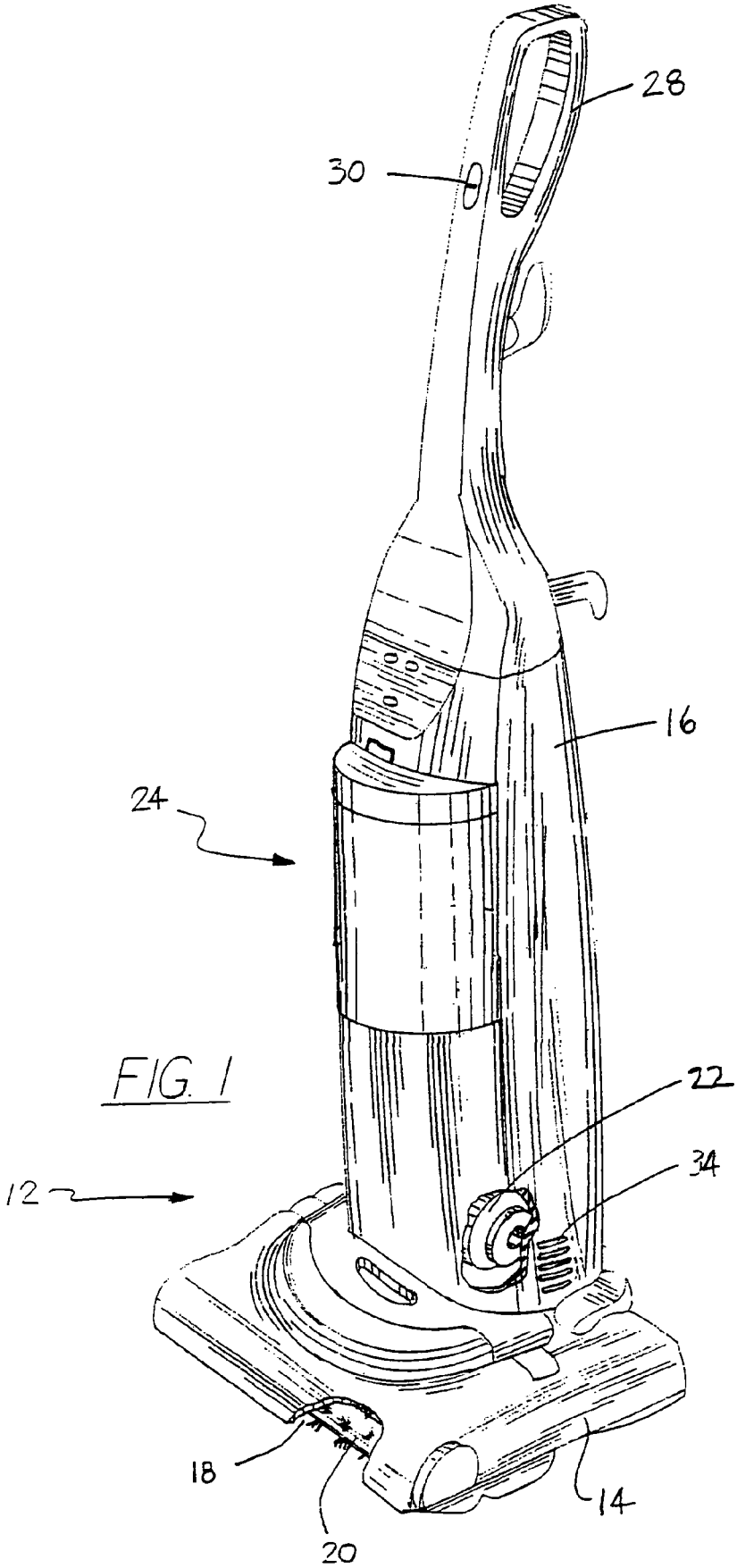
FIG. 1 is a perspective view of one possible embodiment of the vacuum cleaner of the present invention.

Reference is now made to FIG. 1 illustrating one possible embodiment of the vacuum cleaner 10 of the present invention. The illustrated embodiment is an upright vacuum cleaner 10. It should be appreciated, however, that the present invention also includes and this patent covers canister and hand-held vacuum cleaners.

The vacuum cleaner 10 includes a housing, generally designated by reference numeral 12, including a nozzle section 14 and a canister section 16. As is known in the art, the canister section 16 is pivotally connected to the nozzle section 14 to aid the operator in manipulating the vacuum cleaner 10 to and fro across the floor. Wheels (not shown) carried on the housing 12 allow the vacuum cleaner 10 to be moved smoothly across the floor. As illustrated, the nozzle section 14 is equipped with a nozzle inlet 18. In the illustrated embodiment, the nozzle inlet 18 also includes a rotary agitator 20.

The canister section 16 houses a suction generator 22 (i.e. a fan and motor assembly) and a dirt vessel 24 having a dirt collection chamber 26. The canister section 16 also includes a control handle 28 and an actuator switch 30 for turning the vacuum cleaner 10 on and off and thereby driving the rotary agitator 20 and the suction generator 22.

During the cleaning operation the rotary agitator 20 brushes and beats dirt and debris from the nap of an underlying carpet being cleaned. That dirt and debris is then drawn by the suction generator 22 through the nozzle inlet 18 into the dirt vessel 24 where dirt and debris are collected in the chamber 26. The airstream is then directed over the motor of the suction generator 22 to provide cooling before being routed through a final filter, to remove any carbon particles stripped from the brushes of the motor by the airstream, before exhausting the airstream through an exhaust port 32 into the environment.

Figure 2:
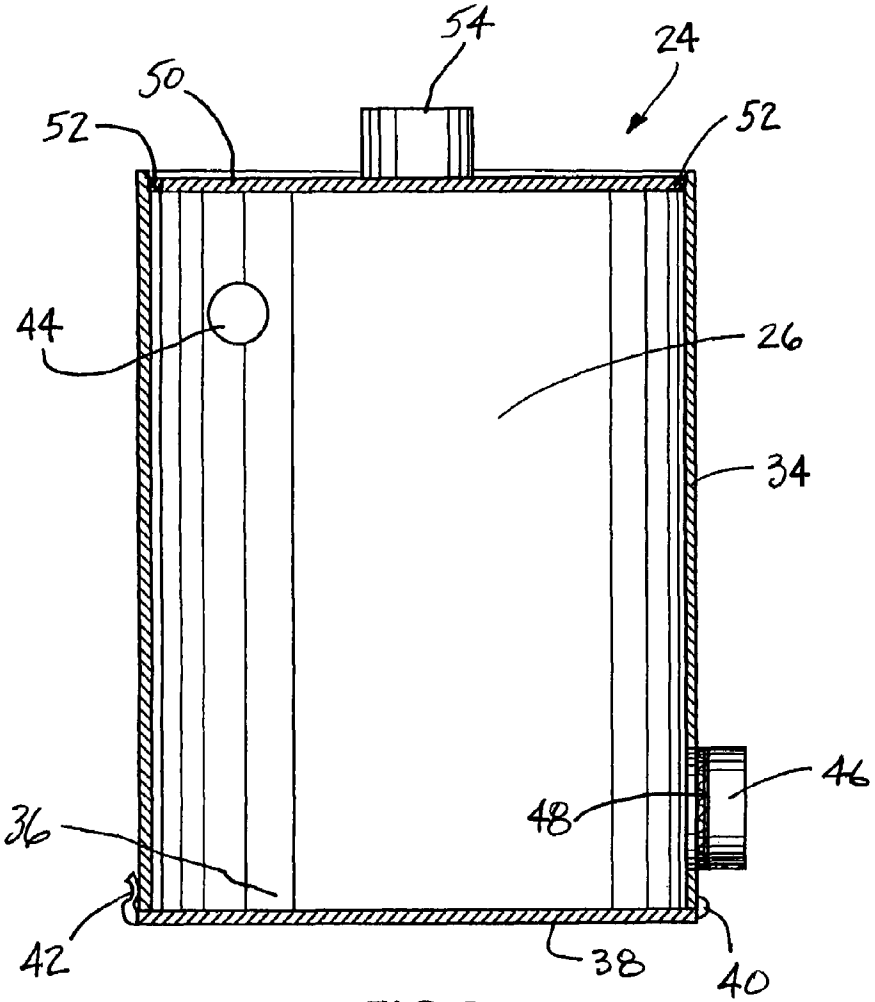

One possible embodiment of the dirt vessel 24 of the present invention is illustrated in FIG. 2. As illustrated in that figure, the dirt vessel 24 includes a sidewall 34 having an open end 36 closed by a door 38. The door 38 may be connected to the sidewall 34 by means of a hinge 40. A latch 42 cooperates with the hinge 40 to secure the door 38 to the sidewall 34 and close the open end of the dirt vessel 24. Together, the sidewall 34 and door 38 define the dirt collection chamber 26. In the illustrated embodiment the dirt collection chamber 26 is substantially cylindrical in shape. It should be appreciated, however, that the dirt vessel 24 and the dirt collection chamber 26 may assume any number of shapes and configurations.

As further illustrated in FIG. 2 an inlet 44 and an outlet 46 are both provided in the sidewall 34. The outlet 46 is covered by a screen or grating 48 which functions to filter dirt and debris from the airstream. That dirt and debris then collects in the dirt collection chamber 26. The dirt vessel 24 also includes a plunger 50. As illustrated, the plunger 50 includes a margin holding a cleaning element 52 that slidably engages the inner surface of the sidewall 34. The cleaning element 52 may assume substantially any appropriate form including, for example, a resilient wiper, a brush or a pad. Materials utilized to construct the cleaning element include but are not limited to rubber such as neoprene, low friction plastic material such as nylon, natural or synthetic bristles and soft fabric such as felt.

Figure 5:
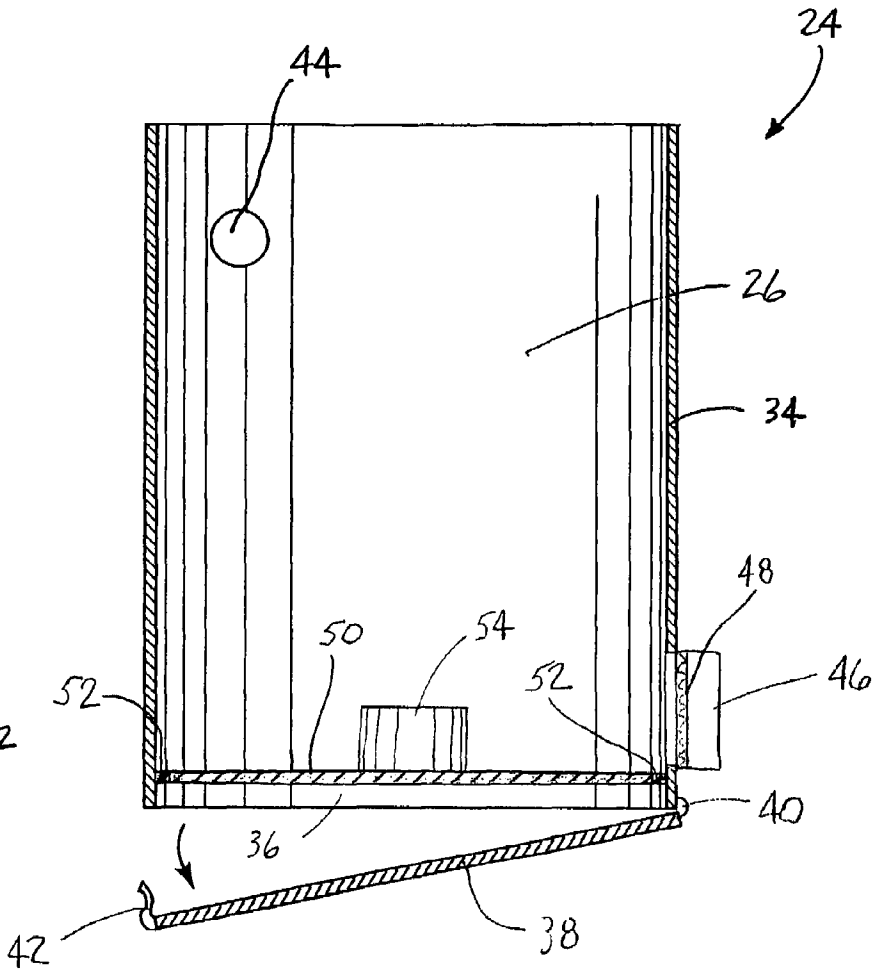
FIG. 5 is a view similar to FIG. 2 but illustrating that embodiment when the plunger has been fully displaced through the dirt vessel to clean dirt and debris from the dirt collection chamber in the vessel.

As best illustrated from reviewing FIGS. 2 and 5, the plunger 50 is selectively displaceable between a first position away from the open end 36 of the dirt vessel 24 (see FIG. 2) and a second position adjacent to the open end (see FIG. 5).

During vacuum cleaner operation, the plunger 50 is located in the first position illustrated in FIG. 2 at the top of the sidewall 34 and away from the open end 36 and door 38. Dirt and debris collects upstream from the screen 48 in the dirt collection chamber 26. Eventually, it becomes necessary to empty the dirt collection chamber 26. In order to do this, the dirt vessel 24 is removed from the canister section 16 of the vacuum cleaner 10. The dirt vessel 24 is then positioned over an open garbage bag, garbage can or the like. The latch 42 is then released so that the door 38 swings open (see FIG. 5) about the hinge 40. The majority of the dirt and debris in the dirt collection chamber 26 then falls under the force of gravity into the underlying garbage receptacle.

The operator may positively eject any remaining debris and clean the sidewall 34 by engaging the handle 54 and displacing the plunger downwardly from the first position illustrated in FIG. 2 to the second position illustrated in FIG. 5. As this is done the cleaning element 52 around the margin of the plunger 50 engages the inner surface of the sidewall 34 cleaning that inner surface of dirt and debris. Where the sidewall 34 is made from transparent material to allow the operator to visually inspect the contents of the dirt collection chamber 26, the cleaning action of the cleaning element 52 is particularly beneficial. Specifically, by cleaning dirt and debris from the inner surface of the sidewall 34, the visibility of the contents of the dirt collection chamber 26 is increased. Thus, this consumer convenience feature is enhanced.

Figure 3:
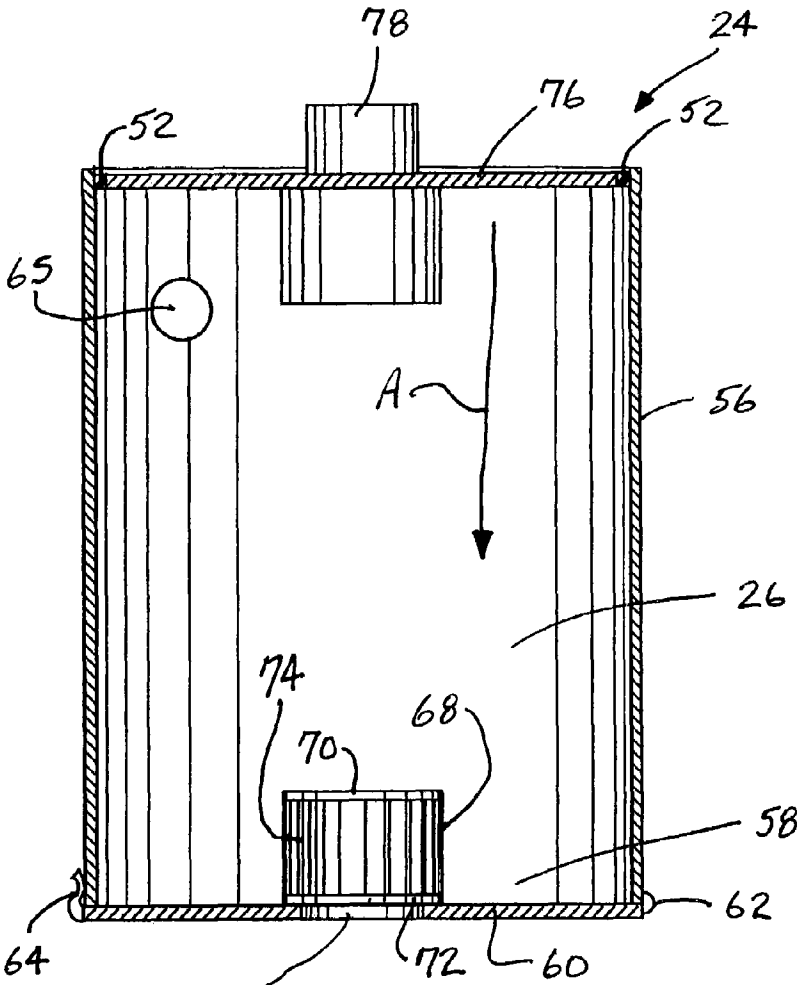
FIGS. 2-4 are detailed, partially schematical, cross-sectional views of three possible embodiments of the dirt vessel assembly of the present invention.

Another possible alternative embodiment of the dirt vessel 24 is illustrated in FIG. 3. In this embodiment, the dirt vessel 24 again includes a sidewall 56 having an open end 58. A door 60 closes the open end. Again, the door may be connected to the sidewall 56 by means of a hinge 62. A latch 64 allows the door to be held closed against the sidewall 56 in order to close the open end 58.

In the illustrated embodiment the sidewall 56 and door 60 define a cylindrical dirt collection chamber 26. An inlet 65 is provided in the sidewall 56. That inlet may be tangentially directed with respect to the sidewall 56 and the dirt collection chamber 26 so as to establish a vortex airstream in the dirt collection chamber. Such an arrangement provides cyclonic cleaning action which often provides higher cleaning efficiencies. An outlet 66 is provided in the door 60. The door 60 also carries a filter element 68 covering the outlet 66. The filter element 68 includes a frame comprising a pair of end walls 70, 72 that hold a pleated filter media 74. Air entrained with dirt and debris entering the dirt collection chamber through the inlet 65 is discharged therefrom through the outlet 66 after passing through the filter media 74 and an opening in the center of the end wall 72. Thus, dirt and debris is trapped and collected in the dirt collection chamber 26 while clean air passes downstream to the suction generator 22.

The FIG. 3 embodiment is also equipped with a plunger 76. The plunger 76 is identical to the plunger 50 illustrated in the FIG. 2 embodiment. Accordingly, the margin of the plunger 76 holds a cleaning element 52 for engaging and cleaning the sidewall 56 of the dirt vessel 24.

When it is desired to empty dirt and debris from the dirt vessel 24 of the FIG. 3 embodiment, the latch 64 is released and the door 60 swings open about the hinge 62 under the force of gravity. Most of the dirt and debris also falls under the force of gravity into the underlying garbage receptacle. The plunger 76 is displaced downwardly in the direction of action arrow A from the first position illustrated in FIG. 3 until it is adjacent to the open end 58 of the dirt vessel 24 using the handle 78. Advantageously, the cleaning element 52 cleans dirt and debris from the sidewall 56 by frictional contact. Where the sidewall 56 is made from transparent material, this enhances the visibility of the contents of the dirt collection chamber 26 through the sidewall. Consequently, the operator can more easily monitor the airflow through the dirt vessel 24 and the level of dirt and debris in the vessel.

Figure 4:
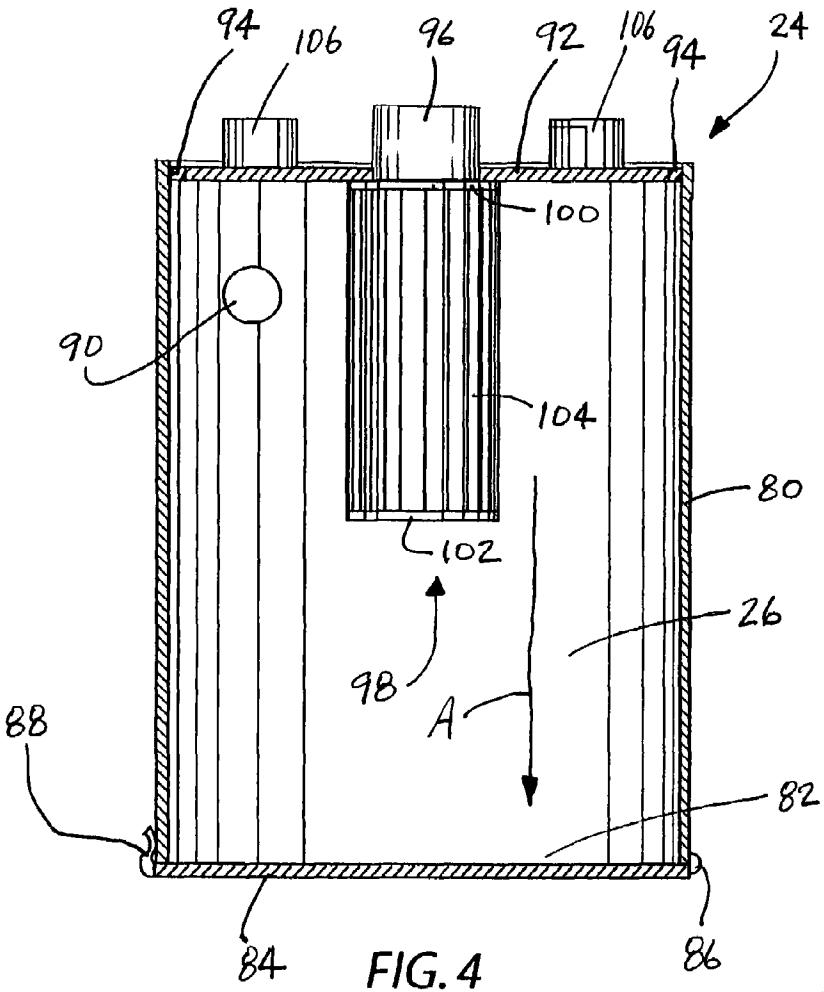

Yet another embodiment of the dirt vessel 24 of the present invention is illustrated in FIG. 4. Similar to the other embodiments, the dirt vessel 24 of FIG. 4 includes a sidewall 80 having an open end 82 closed by a door 84. The door 84 is connected to the sidewall 80 by means of a hinge 86 and a cooperating latch 88. An inlet 90 is provided in the sidewall 80.

The dirt vessel 24 illustrated in FIG. 4 also includes a plunger 92. Similar to the plungers 50 and 76, the plunger 92 includes a margin holding a cleaning element 94. That cleaning element 94 engages the inner surface of the sidewall 80. In contrast to the other plunger embodiment, the plunger 92 includes an outlet 96. Further, the plunger 92 carries a filter element 98 that covers the outlet 96. The filter element 98 includes a frame having two end walls 100, 102. The end wall 100 may be threaded to or connected by tabs or other cooperating means to the plunger 92. A pleated filter media 104 of a type well known in the art is held between the end walls 100, 102 of the filter element 98.

In the embodiment illustrated in FIG. 4, the sidewall 80 and door 84 define a cylindrical dirt collection chamber. The inlet 90 is tangentially directed with respect to the sidewall 80 and that dirt collection chamber 26. Thus, dirty air and debris from the nozzle inlet 18 enters the dirt vessel 24 through the inlet 90. A cyclonic airflow is established to aid in the separation of dirt and debris from the airstream. The airstream passes through the filter media 104 of the filter element 98 and dirt and debris is trapped in the dirt collection chamber 26. The clean air then travels through the outlet 96 to the suction generator 22.

When it becomes necessary to empty dirt and debris from the dirt vessel 24, the dirt vessel is removed from the canister section 16 and placed over a trash receptacle. The latch 88 is released and the door 84 swings open about the hinge 86. The majority of dirt and debris simply falls under the force of gravity from the dirt vessel. If desired, the operator may engage the handles 106 and displace the plunger 92 from the first position illustrated in FIG. 4 in the direction of action arrow A to a second position adjacent the open end 82 of the sidewall 80. During displacement the cleaning element 94 sweeps and scrubs and dirt and debris from the interior surface of the sidewall 80. Accordingly, visibility through the sidewall is enhanced. This allows the user to more readily monitor the operating condition of the dirt vessel 24.

The foregoing description of the preferred embodiments of this invention have been presented for purposes of illustration and description. It is not intended to be exhaustive or to limit the invention to the precise form disclosed. Obvious modifications or variations are possible in light of the above teachings.

For example, while the illustrated embodiment is an upright vacuum cleaner, the present invention also relates to and includes canister and hand-held vacuum cleaners. Further, while the illustrated embodiment is a "clean air" system with the suction generator 22 downstream from the dirt cup 24 and dirt collection chamber 26, the present invention also includes "dirty air" systems where the suction generator is located upstream of either or both of these structures. Further, while the inlet is provided in the sidewall of the dirt vessel in all of the illustrated embodiments, it should be appreciated that the inlet could also be provided in the plunger or the door. Similarly, the outlet could also be provided in the sidewall, the plunger or the door.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed:

1. A vacuum cleaner, comprising:

a housing including a nozzle section and a canister section wherein said nozzle section and said canister section are pivotally connected together;

a nozzle inlet on said nozzle section;

a suction generator carried on said housing;

a dirt vessel carried on said housing, said dirt vessel including a sidewall and an open end; and a plunger received in said dirt vessel, said plunger being selectively displaceable between a first position spaced along said sidewall away from said open end and a second position spaced along said sidewall adjacent said open end and wherein said plunger includes a margin slidingly engaging an inner surface of said sidewall.

2. The vacuum cleaner of claim 1, wherein said margin includes a cleaning element in engagement with said sidewall.

3. The vacuum cleaner of claim 2, wherein said cleaning element is a resilient wiper.

4. The vacuum cleaner of claim 2, further including a door for closing said open end of said dirt vessel.

5. The vacuum cleaner of claim 4, wherein said door is connected by a hinge to said sidewall.

6. The vacuum cleaner of claim 5, further including a latch for securing said door in a closed position relative to said sidewall.

7. The vacuum cleaner of claim 4, wherein said dirt vessel includes an inlet and an outlet.

8. The vacuum cleaner of claim 7, wherein said inlet is in said sidewall.

9. The vacuum cleaner of claim 4, further including a filter element in said dirt vessel.

10. The vacuum cleaner of claim 9, wherein said filter element is cylindrical in shape.

11. The vacuum cleaner of claim 10, wherein said dirt vessel defines a dirt collection chamber that is cylindrical in shape and said filter element is concentrically received within said chamber.

12. The vacuum cleaner of claim 4, wherein an inlet is in said sidewall and an outlet is in said plunger.

13. The vacuum cleaner of claim 12, wherein said plunger carries a filter element on said outlet.

14. The vacuum cleaner of claim 13, wherein said sidewall and said door define a cylindrical dirt collection chamber.

15. The vacuum cleaner of claim 14, wherein said filter element is cylindrical.

* * * * *